US010721555B2

(12) United States Patent
Christoph

(10) Patent No.: US 10,721,555 B2
(45) Date of Patent: Jul. 21, 2020

(54) ACTIVE NOISE REDUCTION IN HEADPHONES

(71) Applicant: HARMAN BECKER AUTOMOTIVE SYSTEMS GMBH, Karlsbad (DE)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/149,857

(22) Filed: May 9, 2016

(65) Prior Publication Data

US 2016/0329042 A1 Nov. 10, 2016

(30) Foreign Application Priority Data

May 8, 2015 (EP) ..... 15167002.3

(51) Int. Cl.
*G10K 11/178* (2006.01)
*H04R 1/32* (2006.01)
(Continued)

(52) U.S. Cl.
CPC ..... *H04R 1/326* (2013.01); *G10K 11/1787* (2018.01); *G10K 11/17813* (2018.01);
(Continued)

(58) Field of Classification Search
CPC ..... G10K 11/178; G10K 11/1784; G10K 11/1788; G10K 2210/1081;
(Continued)

(56) References Cited

U.S. PATENT DOCUMENTS 4,654,546 A 3/1987 Kirjavainen
5,831,936 A 11/1998 Zlotnick et al.
(Continued)

FOREIGN PATENT DOCUMENTS

CN 101179873 A 5/2008
CN 101222787 A 7/2008
(Continued)

OTHER PUBLICATIONS

European Search Report for Application No. 15167002.3, dated Oct. 30, 2015, 6 pages.
(Continued)

*Primary Examiner* — Ping Lee
(74) *Attorney, Agent, or Firm* — Brooks Kushman P.C.

(57) ABSTRACT

Embodiments are disclosed relating to an active noise reducing system and method for a headphone with a rigid cup-like shell which has an outer surface and an inner surface that encompasses a cavity with an opening. The system and method include picking up sound at least at three positions that are regularly distributed over the outer surface, and providing a first electrical signal that represents the picked-up sound. The system and method further include: filtering the first electrical signal to provide a second electrical signal, and generating in the opening of the cavity sound from the second electrical signal. Filtering is performed with a transfer characteristic that is configured so that noise that travels through the shell from beyond the outer surface to beyond the inner surface is reduced by the sound generated in the opening.

10 Claims, 3 Drawing Sheets

(51) Int. Cl.
*H04R 1/10* (2006.01)
*H04R 3/00* (2006.01)

(52) U.S. Cl.
CPC ..... *G10K 11/17854* (2018.01); *H04R 1/1008* (2013.01); *H04R 1/1083* (2013.01); *H04R 3/005* (2013.01); *G10K 2210/1081* (2013.01); *G10K 2210/3026* (2013.01); *G10K 2210/3027* (2013.01); *G10K 2210/3028* (2013.01); *G10K 2210/3045* (2013.01); *G10K 2210/3055* (2013.01); *G10K 2210/3219* (2013.01); *H04R 2460/01* (2013.01)

(58) Field of Classification Search
CPC .... G10K 2210/3026–3028; G10K 2210/3219; G10K 2210/3045; G10K 2210/3055; H04R 3/005; H04R 1/326; H04R 1/1008; H04R 1/1083; H04R 2460/01
See application file for complete search history.

(56) References Cited

U.S. PATENT DOCUMENTS

| | | | | |
|---|---|---|---|---|
| 8,184,823 | B2 | 5/2012 | Itabashi et al. | |
| 8,447,045 | B1 | 5/2013 | Laroche | |
| 8,750,531 | B2 | 6/2014 | Delano et al. | |
| 8,903,101 | B2 | 12/2014 | Christoph et al. | |
| 2008/0159555 | A1 | 7/2008 | Asada et al. | |
| 2009/0175466 | A1 | 7/2009 | Elko et al. | |
| 2009/0268931 | A1 | 10/2009 | Andrea et al. | |
| 2010/0316231 | A1* | 12/2010 | Williams | H04R 3/005 381/92 |
| 2011/0130176 | A1* | 6/2011 | Magrath | G10K 11/178 381/71.1 |
| 2011/0158419 | A1* | 6/2011 | Theverapperuma | G10K 11/17885 381/71.1 |
| 2013/0028435 | A1 | 1/2013 | Christoph | |
| 2013/0208908 | A1* | 8/2013 | Theiler | G10K 11/178 381/71.6 |
| 2013/0274628 | A1* | 10/2013 | Fausti | A61B 5/123 600/559 |
| 2014/0311499 | A1* | 10/2014 | Lee | G01R 33/288 381/71.6 |

FOREIGN PATENT DOCUMENTS

| | | | |
|---|---|---|---|
| CN | 101257729 | A | 9/2008 |
| CN | 101589628 | A | 11/2009 |
| CN | 102099852 | A | 6/2011 |
| CN | 102170602 | A | 8/2011 |
| CN | 102209987 | A | 10/2011 |
| CN | 102823272 | A | 12/2012 |
| CN | 102859581 | A | 1/2013 |
| CN | 103428608 | A | 12/2013 |
| EP | 2552125 | A1 | 1/2013 |
| EP | 2624251 | B1 | 9/2014 |
| GB | 2461315 | A | 12/2009 |

OTHER PUBLICATIONS

Kuo et al., "Active Noise Control: A Tutorial Review", Proceedings of the IEEE, vol. 87, No. 6, Jun. 1999, pp. 943-973.

Lekkala et al., "EMFi—New Electret Material for Sensors and Actuators", 10th International Symposium on Electrets, IEEE, 1999, pp. 743-746.

* cited by examiner

ACTIVE NOISE REDUCTION IN HEADPHONES

CROSS-REFERENCE TO RELATED APPLICATIONS

This application claims priority to EP Application Serial No. 15167002.3 filed May 8, 2015, the disclosure of which is hereby incorporated in its entirety by reference herein.

TECHNICAL FIELD

The disclosure relates to active noise control (ANC) headphones and a method for operating ANC headphones.

BACKGROUND

Headphones may include active noise reduction, also known as active noise cancelling (ANC). Generally, noise reduction may be classified as feedback noise reduction or feedforward noise reduction or a combination thereof. In a feedback noise reduction system a microphone is positioned in an acoustic path that extends from a noise source to the ear of a listener. A speaker is positioned between the microphone and the noise source. Noise from the noise source and anti-noise emitted from the speaker are collected by the microphone and, based on the residual noise thereof, the anti-noise is controlled to reduce the noise from the noise source. In a feedforward noise reduction system, a microphone is positioned between the noise source and the speaker. The noise is collected by the microphone, is inverted in phase and is emitted from the speaker to reduce the external noise. In a combined feedforward/feedback (hybrid) noise reduction system, a first microphone is positioned in the acoustic path between the speaker and the ear of the listener. A second microphone is positioned in the acoustic path between the noise source and the speaker and collects the noise from the noise source. The output of the second microphone is used to make the transmission characteristic of the acoustic path from the first microphone to the speaker the same as the transmission characteristic of the acoustic path along which the noise from the noise source reaches the listener's ear. The speaker is positioned between the first microphone and the noise source. The noise collected by the first microphone is inverted in phase and emitted from the speaker to reduce the external noise. It is desired to improve the known headphones in order to reduce the noise emitted by a multiplicity of noise sources from a multiplicity of directions.

SUMMARY

An active noise reducing headphone comprises a rigid cup-like shell having an inner surface and an outer surface, wherein the inner surface encompasses a cavity with an opening. The headphone further comprises a microphone arrangement configured to pick up sound at least at three positions that are regularly distributed over the outer surface, and to provide a first electrical signal that represents the picked-up sound, and an active noise control filter configured to provide, based on the first electrical signal, a second electrical signal. Furthermore, the headphone comprises a speaker disposed in the opening of the cavity and configured to generate sound from the second electrical signal. The active noise control filter has a transfer characteristic that is configured so that noise that travels through the shell from beyond the outer surface to beyond the inner surface is reduced by the sound generated by the speaker.

An active noise reducing method is disclosed for a headphone with a rigid cup-like shell which has a convex surface and a concave surface that encompasses a cavity with an opening. The method comprises picking up sound at least at three positions that are regularly distributed over the convex surface, and providing a first electrical signal that represents the picked-up sound. The method further comprises: filtering the first electrical signal to provide a second electrical signal, and generating in the opening of the cavity sound from the second electrical signal. Filtering is performed with a transfer characteristic that is configured so that noise that travels through the shell from beyond the convex surface to beyond the concave surface is reduced by the sound generated in the opening.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The disclosure may be better understood from the following description of non-limiting embodiments with reference to the attached drawings, wherein below.

DETAILED DESCRIPTION

Figure 1:
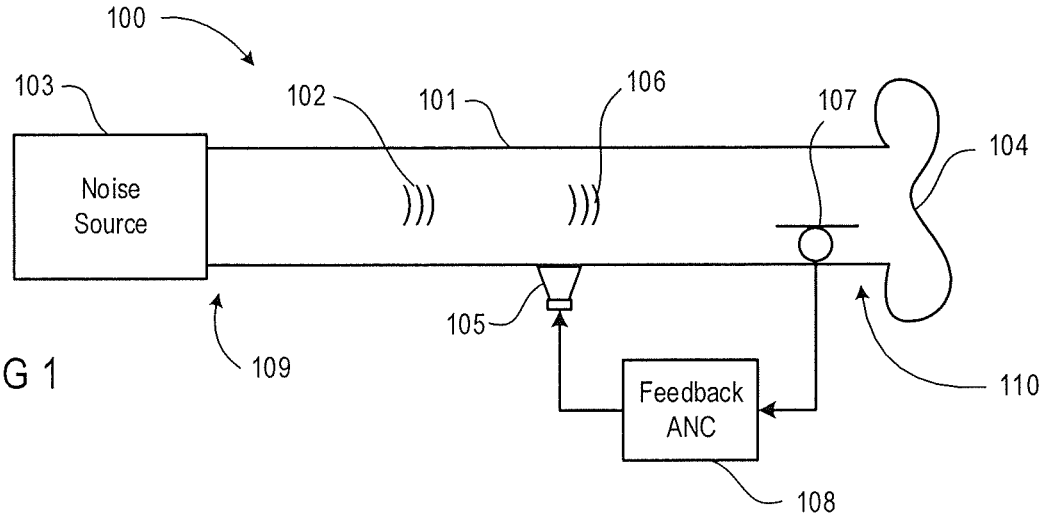
FIG. 1 is a simplified illustration of an exemplary feedback type active noise control (ANC) earphone.

FIG. 1 is a simplified illustration of an exemplary feedback type active noise control (ANC) earphone 100 (e.g., as part of a headphone with two earphones). An acoustic path (also referred to as channel), represented by a tube 101, is established by the ear canal, also known as external auditory meatus, and parts of the earphone 100, into which noise, i.e., primary noise 102, is introduced at a first end 109 from a noise source 103. The sound waves of the primary noise 102 travel through the tube 101 to the second end 110 of the tube 101 from where the sound waves are radiated, e.g., to the tympanic membrane of a listener's ear 104 when the earphone 100 is attached to the listener's head. In order to reduce or cancel the primary noise 102 in the tube 101, a sound radiating transducer, e.g., a speaker 105, introduces cancelling sound 106 into the tube 101. The cancelling sound 106 has an amplitude corresponding to or being the same as the primary noise 102, however, of opposite phase. The primary noise 102 which enters the tube 101 is collected by an error microphone 107 and is processed by a feedback ANC processing module 108 to generate a cancelling signal and then emitted by the speaker 105 to reduce the primary noise 102. The error microphone 107 is arranged downstream of the speaker 105 and thus is closer to the second end 110 of the tube 101 than to the speaker 105, i.e., it is closer to the listener's ear 104, in particular to its tympanic membrane.

Figure 2:
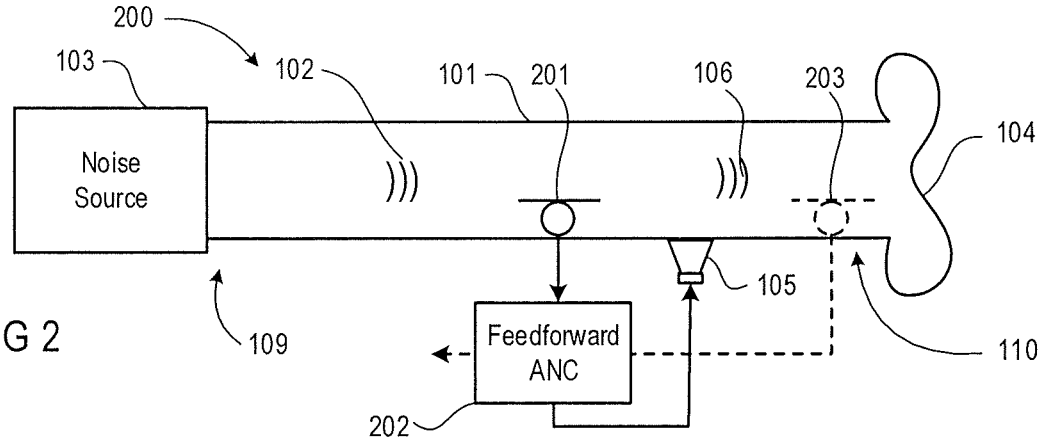
FIG. 2 is a simplified illustration of an exemplary feedforward type ANC earphone.

FIG. 2 is a simplified illustration of an exemplary feedforward type ANC earphone 200. The earphone 200 differs from the earphone 100 shown in FIG. 1 in that a microphone 201 is arranged between the first end 109 of the tube 101 and the speaker 105, instead of being arranged between the speaker 105 and the second end 110 of the tube 101 as is microphone 107 in the earphone 100 shown in FIG. 1. Furthermore, instead of the feedback ANC processing module 108, a feedforward ANC processing module 202 is connected between the microphone, i.e., microphone 201, and speaker 105. The feedforward ANC processing module 202 as shown may be, for example, a non-adaptive filter, i.e., a filter with fixed transfer function, but can alternatively be adaptive in connection with an additional error microphone 203 which is disposed between the speaker 105 and the second end 110 of the tube 101 and which controls (the transfer function of) the feedforward ANC processing module 202.

Figure 3:
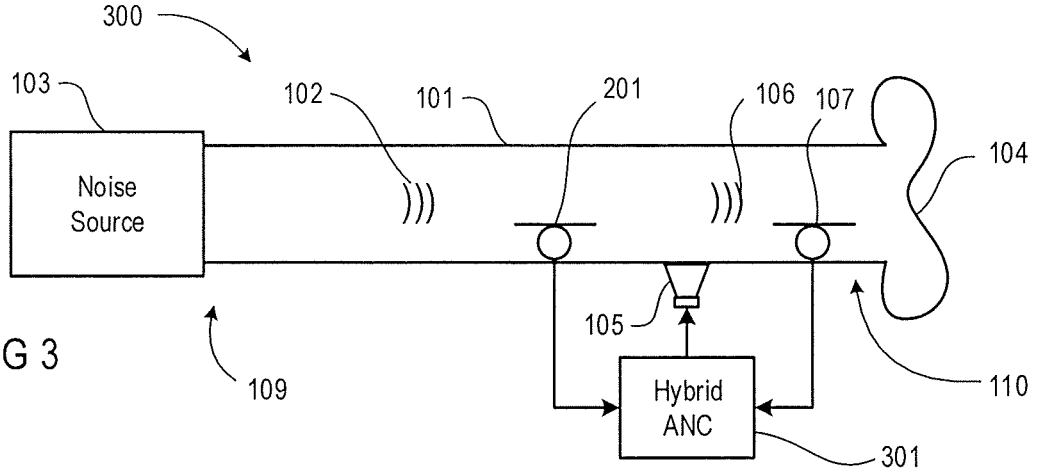
FIG. 3 is a simplified illustration of an exemplary hybrid type ANC earphone.

FIG. 3 is a simplified illustration of an exemplary hybrid type ANC earphone 300. Based on the headphones 100 and 200 described above in connection with FIGS. 1 and 2, the (reference) microphone 201 senses the primary noise 102 and its output is used to model the transmission characteristic of a path from the speaker 105 to the (error) microphone 107, such that it matches the transmission characteristic of a path along which the primary noise 102 reaches the second end 110 of the tube 101. The primary noise 102 and sound radiated from the speaker 105 are sensed by the (error) microphone 107, inverted in phase using the adapted (e.g., estimated) transmission characteristic of the signal path from the speaker 105 to the error microphone 107 and is then emitted by the speaker 105 disposed between the two microphones 201 and 107, thereby reducing the undesirable noise at the listener's ear 104. Signal inversion, transmission path modeling (estimation) and, as the case may be, adaptation are performed by a hybrid ANC processing module 301. For example, the hybrid ANC processing module 301 may include a feedforward processing module similar to the feedforward ANC processing module 202 shown in FIG. 2 to process the signal from microphone 201, and a feedback processing module similar to the feedback ANC processing module 108 shown in FIG. 1 to process the signal from microphone 107.

Figure 4:
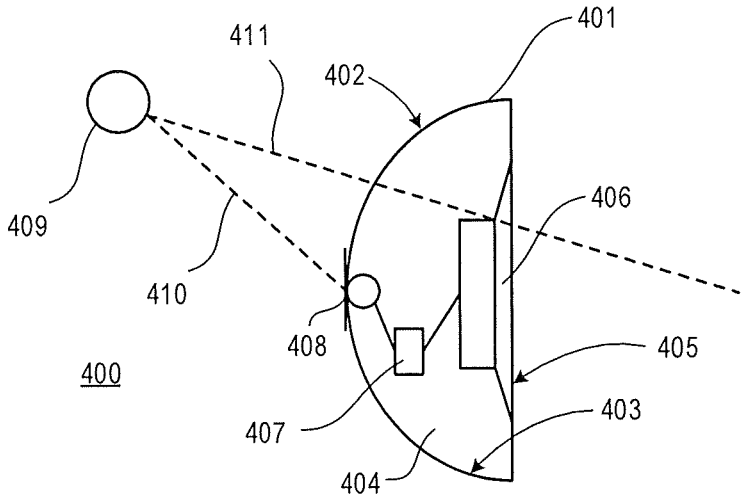
FIG. 4 is a simplified illustration of an exemplary earphone with a conventional single small (reference) microphone.

In an exemplary earphone 400 (part of a feedfoward ANC headphone with two earphones) shown in FIG. 4, a rigid cup-like shell 401 has an inner, e.g., convex surface 402, and an outer, e.g., concave surface 403 which encompasses a cavity 404 with an opening 405. An electro-acoustic transducer for converting electrical signals into sound, such as a speaker 406, is disposed in the opening 405 of the cavity 404 and generates sound from an electrical signal provided by an active noise control filter 407. The active noise control (ANC) filter 407 is commonly supplied with an electrical signal from only a single (reference) microphone 408, which picks up sound at only one position on the convex surface 402 of the shell 401. The ANC filter 407 may, for example, be configured to provide feedforward type or hybrid type active noise control. Even if the microphone 408 has an omni-directional characteristic, a share 410 of the sound emitted by a noise source 409 may be picked-up by microphone 408 while another share 411 may be not. However, both shares 410 and 411 may reach the ear of a listener (not shown) wearing the headphones so that the sound picked-up by the microphone 408 and, thus, the electrical signal corresponding to the picked-up sound does not or does not fully represent the sound arriving at the listener's ear. How much the microphone signal corresponds to the sound perceived by the listener depends on the position and the directivity of the noise source 409. As a consequence, the noise reduction performance of the headphones is, inter alia, dependent on the position of the noise source 409 relative to the position of the microphone 408 and the directivity of the noise source 409.

Figure 5:
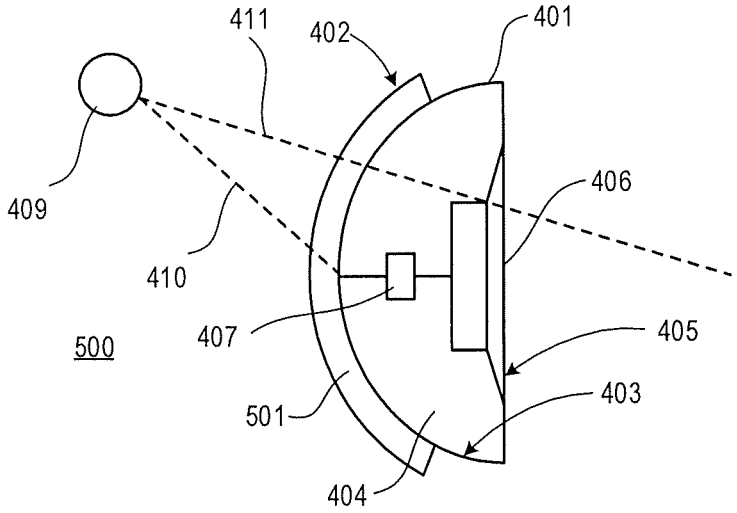
FIG. 5 is a simplified illustration of an exemplary earphone with an areal (reference) microphone.

In an exemplary earphone 500 shown in FIG. 5 which is based on the earphone 400 shown in FIG. 4, the microphone 408 is substituted by an areal microphone 501 (i.e., a microphone with an extended membrane area) that may cover more than 50%, e.g., more than 75%, more than 90%, or up to 100% of the area of the convex surface 401. The areal microphone 501 may be made from any pressure or force sensitive film such as, for example, ElectroMechanical Film (EMFi) which is an electret material with a cellular structure. EMFi's advantage over other solid polymer electrets is based on its flexibility due to the voided internal structure combined with a strong permanent charge, which makes EMFi very sensitive to dynamic forces exerted normal to its surface. The base material may be low-priced polypropylene (PP).

EMFi may consist of several polypropylene layers separated by air voids. An external force exerted to the film's surface will change the thickness of the air voids. The charges residing on the polypropylene/void interfaces will then move in respect to each other, and as a result a mirror charge is generated to the electrodes. The generated charge is proportional to the change of the film thickness. Because of the elasticity of the material, the generated charge is proportional also to the force (or pressure) acting on the film. The basic voided PP-film is manufactured by biaxially orienting a specially fabricated polymer, performed in a continuous process, that forms the cellular structure. More detailed description of the EMFi can be found, e.g., in U.S. Pat. No. 4,654,546 or Jukka Lekkala and Mika Paajanen, "EMFi—New Electret Material for Sensors and Actuators", 10th International Symposium on Electrets, 1999. During the manufacturing process, the EMFi material is charged by a corona discharge arrangement. Finally, the film is coated with electrically conductive electrode layers, completing the EMFi structure. The film has three layers, of which the few microns thick surface layers are smooth and homogeneous, whereas the dominant, thicker mid-section is full of flat voids separated by leaf-like PP-layers.

Alternatively, an areal microphone may be approximated by way of a multiplicity of microphones 601 each with a significantly smaller membrane area than the areal microphone to be approximated. Microphones 601 form a microphone array and are regularly distributed over the convex surface 402 and the directivities of the microphones 601 may be such that they overlap so that for any solid angle of a semi-sphere at least one of the microphones 601 directly receives the noise from a directional noise source at any position.

Figure 7:
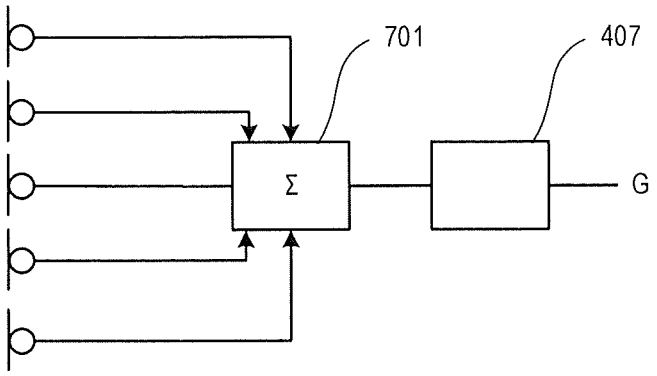
FIG. 7 is a simplified circuit diagram of a circuit connected downstream of the microphone array shown in FIG. 6.

For example, the microphones 602 may have an omnidirectional characteristic and their output signals may be summed up as shown in FIG. 7 by way of a summer 701 to provide an output signal that may substitute the output signal of areal microphone 501 described above in connection with FIG. 5. Due to the summing-up of the microphone output signals, the array of the microphones 602 exhibit a similar directional behavior as the areal microphone, which means it can be seen as a sensor that acoustically captures the zeroth room mode. Furthermore, due to the summing-up of the microphone output signals, noise generated by the microphones is reduced by 10 $\log_{10}$ (N) [dB], wherein N is the number of microphones used. On top of that, commonly the noise behavior of small membrane microphones 602 is already per se better than that of the areal microphone 501.

Figure 6:
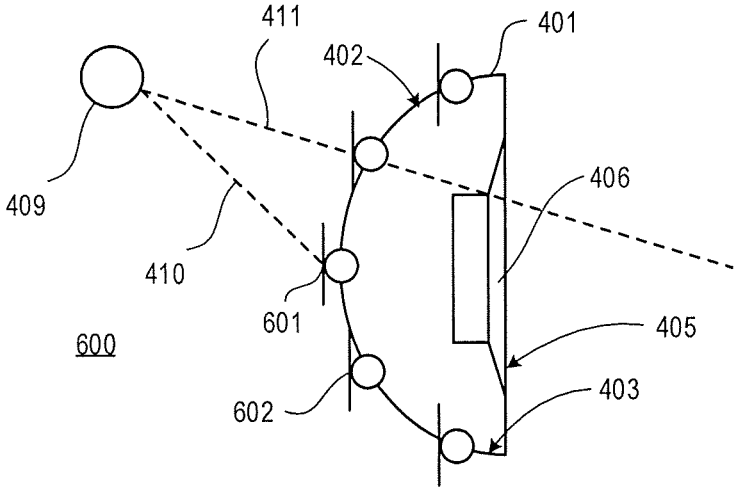
FIG. 6 is a simplified illustration of an exemplary earphone with a (reference) microphone array that approximates an areal microphone.
Figure 8:
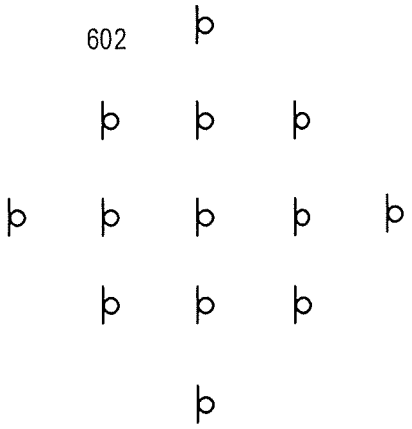
FIG. 8 is a simplified illustration of an exemplary array of microphones regularly arranged over the shell of an earphone.

FIG. 8 is a front view of the array of the microphones 602, a lateral view of which is shown in FIG. 6. As can be seen, the microphones are regularly distributed over the convex surface 402 which means that the microphones 602 may be formed, built, arranged, or ordered according to some established rule, law, principle, or type. Particularly, the microphones 602 may be arranged both equilaterally and equiangularly as a regular polygon (two-dimensional arrangement) or may have faces that are congruent regular polygons with all the polyhedral angles being congruent as a regular polyhedron (three-dimensional arrangement). For example, three microphones 602 may be used which can be arranged at the corners of an equilateral triangle. Other arrangements may have four microphones disposed in the corners of a square. A multiplicity of arrangements of regularly distributed three or four microphones or more may be combined to form more complex arrangements. For example, FIG. 8 shows a rhombus-like arrangement of thirteen microphones 602.

Figure 9:
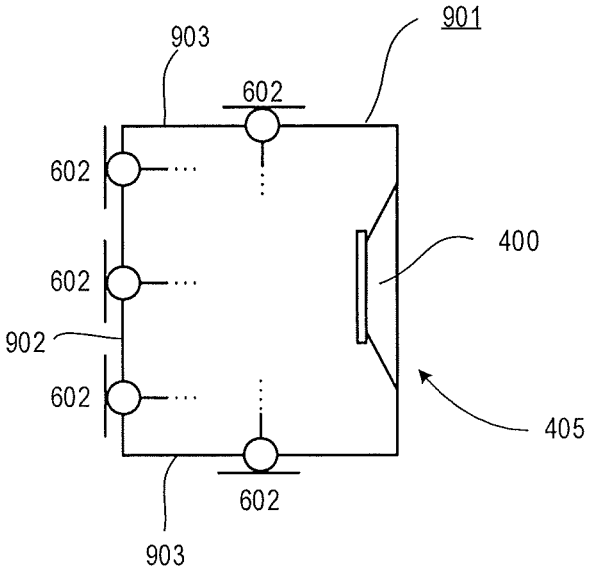
FIG. 9 is a simplified illustration of another exemplary earphone with a microphone array and a shell having a barrel-like shape.

The shell may have various forms such as, for example, a dish-like shape as in the headphone shown in FIGS. 4-6 or a barrel-like shape as shown in FIG. 9 (shell 901) where the microphones 602 are disposed on a bottom wall 902 as well as on a sidewall 903 of a barrel. The ANC filter 407, e.g., in connection with a feedforward ANC or hybrid ANC processing module, may be of a conventional type whose basic adaptive and non-adaptive structures are described, for example, in Sen M. Kuo and Dennis R. Morgan, "Active Noise Control: A Tutorial Review", Proceedings of the IEEE, Vol. 87, No. 6, June 1999.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

What is claimed is:

1. An active noise reducing headphone comprising:

a rigid cup-like shell having an inner surface and an outer surface; the inner surface encompassing a cavity with an opening;

a microphone arrangement configured to receive sound formed on the outer surface, and to provide a first electrical signal that represents the received sound;

an active noise control filter configured to provide, based on the first electrical signal, a second electrical signal; and a speaker disposed in the opening of the cavity and configured to generate sound from the second electrical signal; where the active noise control filter has a transfer characteristic that is configured so that first noise that travels through the shell from beyond the outer surface to beyond the inner surface is reduced by the sound generated by the speaker, the active noise control filter is operatively coupled to the microphone arrangement and, the speaker is operatively coupled to the active noise control filter, and the microphone arrangement comprises an areal microphone that is configured to receive the sound over more than 50% of a surface area of a convex surface of the outer surface.

2. The headphone of claim 1, where the areal microphone is further configured to receive the sound over more than 90% of the surface area of the convex surface.

3. The headphone of claim 1, where the areal microphone comprises a sound pressure sensitive membrane.

4. The headphone of claim 3, where the sound pressure sensitive membrane is made from electro-mechanical film.

5. The headphone of claim 1, where the active noise control filter is connected into a feedforward active noise control path.

6. The headphone of claim 1, wherein the convex surface is formed on the outer surface of the rigid cup-like shell.

7. An active noise reducing method for a headphone with a rigid cup-like shell having an inner surface and an outer surface; the inner surface encompassing a cavity with an opening; the method comprising:

receiving, via a microphone arrangement, sound over the outer surface, and providing a first electrical signal that represents the received sound;

filtering the first electrical signal to provide a second electrical signal to a loudspeaker; and generating in the opening of the cavity, sound from the second electrical signal with the loudspeaker; where:

filtering is performed with a transfer characteristic that is configured so that first noise that travels through the shell from beyond the outer surface to beyond the inner surface is reduced by the sound generated in the opening, and where the microphone arrangement comprises an areal microphone that is configured to receive the sound over more than 50% of a convex area of the outer surface.

8. The method of claim 7, where the areal microphone is further configured to receive the sound over more than 90% of a surface area of the convex surface.

9. An active noise reducing headphone comprising:

a rigid cup-like shell including an outer surface and an inner surface;

a microphone arrangement configured to receive sound over a convex surface of the outer surface, and to provide a first electrical signal that represents the received sound;

an active noise control filter configured to provide, based on the first electrical signal, a second electrical signal; and a speaker disposed in an opening of the shell and configured to generate sound from the second electrical signal, wherein the active noise control filter is arranged such that first noise that travels through the shell from beyond the outer surface to beyond the inner surface is reduced by the sound generated by the speaker, wherein the active noise control filter is operatively coupled to the microphone arrangement, wherein the speaker is operatively coupled to the active noise control filter, and wherein the microphone arrangement comprises an areal microphone that is configured to receive the sound over more than one of: (i) 50% of a surface area of the convex surface, and (ii) 90% of a surface area of the convex surface.

10. The headphone of claim 9 wherein the active noise control filter includes a transfer characteristic that is arranged such that the first noise that travels through the shell from beyond the outer surface to beyond the inner surface is reduced by the sound generated by the speaker.

* * * * *